US009689160B2

(12) United States Patent
Lanese

(10) Patent No.: US 9,689,160 B2
(45) Date of Patent: Jun. 27, 2017

(54) REUSABLE MODULE FOR MANUFACTURING AT LEAST ONE PORTION OF A REPEATEDLY DISMOUNTABLE WALL OF A CONSTRUCTION

(71) Applicant: Flavio Lanese, Aosta (IT)

(72) Inventor: Flavio Lanese, Aosta (IT)

( * ) Notice: Subject to any disclaimer, the term of this patent is extended or adjusted under 35 U.S.C. 154(b) by 0 days.

(21) Appl. No.: 14/649,307

(22) PCT Filed: Dec. 4, 2013

(86) PCT No.: PCT/IB2013/060643
§ 371 (c)(1),
(2) Date: Jun. 3, 2015

(87) PCT Pub. No.: WO2014/087352
PCT Pub. Date: Jun. 12, 2014

(65) Prior Publication Data

US 2015/0300006 A1 Oct. 22, 2015

(30) Foreign Application Priority Data

Dec. 4, 2012 (IT) ..... TO2012A1042

(51) Int. Cl.
*E04B 2/00* (2006.01)
*E04B 2/08* (2006.01)
(Continued)

(52) U.S. Cl.
CPC ..... *E04B 2/08* (2013.01); *E04B 2/06* (2013.01); *E04C 1/39* (2013.01); *E04C 1/397* (2013.01);
(Continued)

(58) Field of Classification Search
CPC ..... E04B 2/08; E04B 2/06; E04B 2002/0245; E04B 2002/0247; E04B 2103/02;
(Continued)

(56) References Cited

U.S. PATENT DOCUMENTS 1,444,554 A 2/1923 Quillet
2,700,295 A 1/1955 Glide
(Continued)

FOREIGN PATENT DOCUMENTS

EP 1498555 1/2005
FR 1062502 4/1954
(Continued)

OTHER PUBLICATIONS

Corresponding International Preliminary Report on Patentbility for PCT/IB2013/060643 dated Jun. 18, 2015.
(Continued)

*Primary Examiner* — Brian Mattei
(74) *Attorney, Agent, or Firm* — The Belles Group, P.C.

(57) ABSTRACT

A dismountable module for manufacturing at least one portion of a repeatably dismountable wall of a construction is described, the module comprising: a first body adapted to define an outer surface of said wall, at least one structural member adapted to withstand the loads generated by the wall; the structural member comprises a main body elongated along a first axis, arranged vertically in use, and a thickening protruding from said main body transversally to said first axis; the thickening defines a first face and a second face opposite to the first face and adapted to cooperate, either directly or indirectly, with a further module, superimposable on said module according to said first axis, so as to transfer a load from the further module to said structural member.

27 Claims, 10 Drawing Sheets

(51) Int. Cl.
*E04B 2/06* (2006.01)
*E04C 1/39* (2006.01)
*E04B 2/02* (2006.01)

(52) U.S. Cl.
CPC ..... *E04B 2002/0245* (2013.01); *E04B 2002/0247* (2013.01); *E04B 2103/02* (2013.01); *E04B 2103/04* (2013.01)

(58) Field of Classification Search
CPC ..... E04B 2103/04; E04B 2/42; E04B 2/16; E04B 2/702; E04B 2002/0254; E04B 2001/3583; E04C 1/39; E04C 1/397
See application file for complete search history.

(56) References Cited

U.S. PATENT DOCUMENTS

| | | | | | |
|---|---|---|---|---|---|
| 2,929,236 | A * | 3/1960 | Steward | E04B 1/06 | 52/223.3 |
| 4,454,699 | A * | 6/1984 | Strobl | F16B 21/082 | 403/298 |
| 4,688,362 | A * | 8/1987 | Pedersen | E04B 2/08 | 52/223.7 |
| 4,975,008 | A * | 12/1990 | Wagner | F02B 77/00 | 411/337 |
| 5,787,675 | A * | 8/1998 | Futagi | E04B 2/702 | 411/389 |
| 6,098,357 | A * | 8/2000 | Franklin | E04B 2/14 | 52/223.7 |
| 6,266,934 | B1 | 7/2001 | Houseal | | |
| 6,282,859 | B1 * | 9/2001 | Van Der Heijden | E04B 2/08 | 403/305 |
| 2003/0029119 | A1 * | 2/2003 | Coleman | E04B 2/08 | 52/604 |
| 2004/0020145 | A1 * | 2/2004 | Matsufuji | E04B 2/42 | 52/223.7 |
| 2006/0194505 | A1 * | 8/2006 | Rolf | A63H 33/086 | 446/118 |
| 2011/0167749 | A1 * | 7/2011 | Azizi Ronagh | E04B 2/16 | 52/571 |
| 2015/0075106 | A1 * | 3/2015 | Vandenbempt | E04B 2/18 | 52/596 |

FOREIGN PATENT DOCUMENTS

| | | |
|---|---|---|
| GB | 2394730 | 5/2004 |
| WO | 2006/075827 | 7/2006 |
| WO | 2009/104047 | 8/2009 |

OTHER PUBLICATIONS

International Search Report for corresponding PCT/IB2013/060643, mailed Mar. 19, 2014.

* cited by examiner

REUSABLE MODULE FOR MANUFACTURING AT LEAST ONE PORTION OF A REPEATEDLY DISMOUNTABLE WALL OF A CONSTRUCTION

TECHNICAL FIELD

The present invention relates to a reusable module for manufacturing at least one portion of a repeatedly dismountable wall of a construction.

The present invention also relates to a method for manufacturing a wall of a construction which can be dismounted more than once.

'Reusable' in this description means a module which is not connected to further modules by means of permanent connection means, such as cement, glue or other chemical bonds.

In this manner, the dismountable wall made with the reusable modules may be dismounted and remounted several times, unlike traditional walls made of modules fixed to one another by means of concrete, glue or other chemical bonders.

BACKGROUND ART

Reusable modules for making temporary walls, such as partitions, outside walls or furniture components, are known in the art, e.g. from patent application WO2009/104047.

The modules described in this patent application essentially comprise a parallelepiped body intended to define an outer surface of the aforesaid wall.

Furthermore, the body of each module comprises:

- an L-shaped protrusion arranged on an upper face and on a first side face of the aforesaid body;
- an L-shaped groove arranged on a lower face and on a second side face, opposite to the first side face, of the aforesaid body at the aforesaid protrusion;
- a series of circular protrusions arranged on the upper face of the aforesaid body; and
- a series of circular grooves obtained on the lower face in position corresponding to respective circular protrusions.

Each module is coupled to at least one further module engaging the protrusions thereof in respective grooves of the further module and coupling the grooves thereof with respective circular protrusions of the further module.

Each module can be further coupled to the further module superimposable on it by means of a pair of threaded tie-rods.

In particular, the threaded tie-rods extend between the superimposed rows of modules and are arranged at a median axis of the modules themselves.

Each tie-rod comprises, in particular, an externally threaded stem crossing a respective module and a head of an upper end, onto which the stem of a further tie-rod crossing the further module is screwed.

The diameter of the head of each tie-rod is slightly larger than the stem and cooperates with the module on one side and with the other module on the other side.

Because of the small diameter of the head, only an extremely small portion of the vertical downward loads acting on the wall is transmitted to the tie-rods themselves.

In other words, the aforesaid tie-rods can exclusively withstand traction stresses bearing on the modules, i.e. can prevent the separation of the modules.

On the other hand, the compression stresses are prevalently relieved on the bodies of the modules. Such bodies must therefore have suitable mechanical properties.

Consequently, the bodies of the modules of known type may be made only of compression resistant materials, in fact limiting the possible embodiments of known type.

For example, it is not possible to use materials having merely cosmetic function to make the modules.

Furthermore, the tie-rods extend between overlapped rows of modules.

This is a further limitation to the possibility of manufacturing constructions or construction other than building constructions of particularly articulated or imaginative shapes.

Patent application PCT/KR2005/001402 describes a system for connecting prefabricated modules according to the preamble of claim 1.

In particular, such a connection system comprises a plurality of bolts extending along respective vertical axes connected to one another to form a plurality of vertical rows.

Each bolt comprises a head and a threaded stem. The head of each bolt defines a nut screw into which the threaded stem of the upper bolt is screwed.

More specifically, the head of each bolt comprises a lower surface, which comes into contact with the lower module, and an upper surface, which is distanced from the upper module.

Because of such a conformation, the bolts have the exclusive function of preventing the separation of the modules, without withstanding the downward compression loads, e.g. due to weight, acting on the wall, which are absorbed by the modules only.

A very similar solution is described in patent application FR-A-1062592.

The need is felt in the sector to use the same connection members for preventing the separation of the modules and for withstanding a significant portion of the downward compression loads.

Patent applications EP-A-1498555 and U.S. Pat. No. 2,700,295 illustrate modules connected to one another by casting a binder, e.g. cement.

U.S. Pat. No. 599,864 describes modules comprising respective downward tapering conical cavities and a connection system for connecting such superimposed modules to one another, essentially formed by downward tapering conical members inserted in respective conical cavities of the superimposed modules.

By virtue of such a conformation, the connection system illustrated in U.S. Pat. No. 599,864 does not oppose any resistance to the upwards distancing of the upper module from the lower module, making it entirely unsuitable to make temporary walls adapted to withstand loads of a given entity.

It is further felt in the sector the need to guarantee maximum versatility with respect to the final configurations of the construction and/or to the choice of the material with which to make the modules.

It is further felt in the sector the need to allow the assembly and disassembly of the constructions as simply and rapidly as possible and, in particular, without requiring the use of specialized manpower and/or demolitions/removal/landfill disposal operations.

Finally, it is felt in the sector the need to allow the implementation of technological networks, such as electrical systems or hydraulic networks, within the construction.

DISCLOSURE OF THE INVENTION

It is the object of the present invention to manufacture a reusable module for manufacturing at least one portion of a dismountable wall of a construction, which allows to satisfy at least one of the needs specified above.

The aforesaid object is reached by the present invention in that it relates to a reusable module for manufacturing at least one portion of a repeatedly dismountable wall of a construction, as defined in claim 1.

The present invention also relates to a method for manufacturing a repeatedly dismountable wall of a construction as defined in claim 27.

BRIEF DESCRIPTION OF THE DRAWINGS

For a better understanding of the present invention, three preferred embodiments will now be described, by way of non-limitative example only and with reference to the accompanying figures, in which.

BEST MODE FOR CARRYING OUT THE INVENTION

Figure 1:
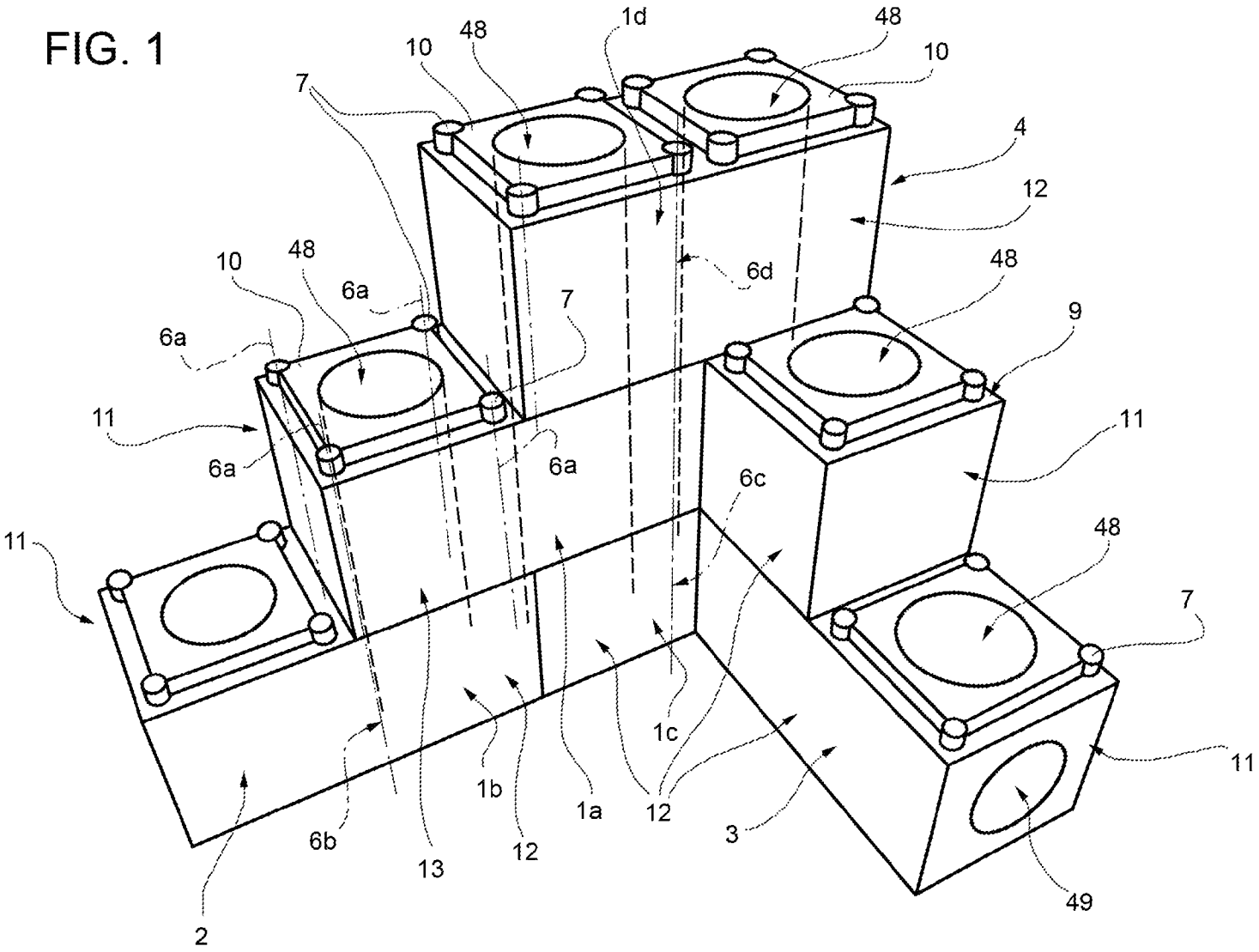
FIG. 1 is a perspective view of a portion of a construction comprising a plurality of reusable modules according to a first embodiment of the present invention.
Figure 2:
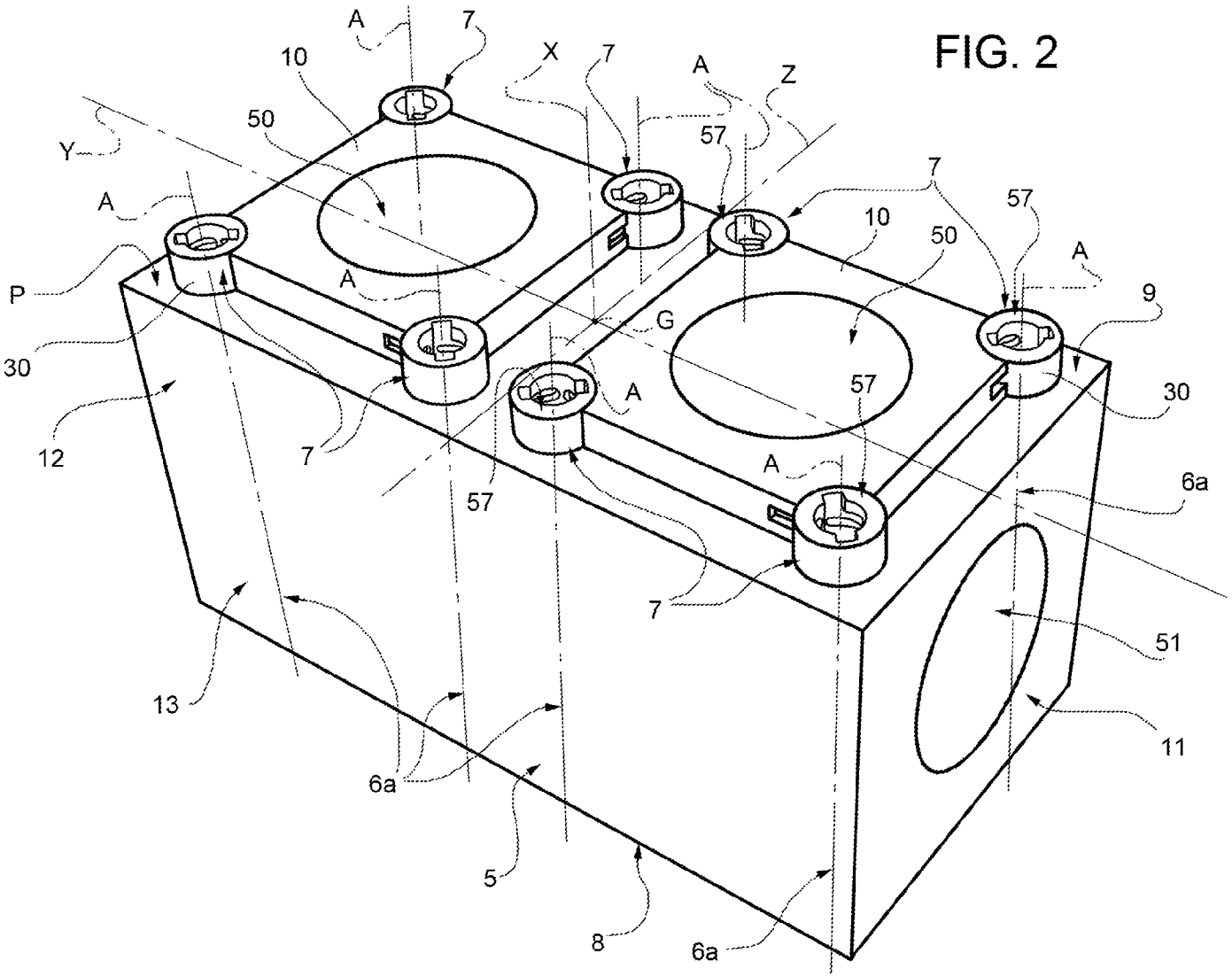
FIG. 2 is a perspective view on a further magnified scale of a reusable module according to the present invention.

In FIGS. 1 and 2, reference numerals 1*a*, 1*b*, 1*c*, 1*d* indicate a reusable dismountable module for manufacturing a wall 2, 3 of a construction 4 which can be dismounted several times.

In particular, the construction 4 could be used in the building sector and in other sectors and could be a partition, an outer wall, a piece of furniture, a container, a piece of leisure equipment or an artistic creation.

Each module 1*a*, 1*b*, 1*c*, 1*d* can be reused several times because it is not restrained to the further modules 1*a*, 1*b*, 1*c*, 1*d* by means of a permanent binder, such as for example cement, glue or chemical binders.

For this reason, the construction 4 can be mounted and dismounted several times.

In the illustrated case in point, the module 1*a* is vertically superimposed on a pair of modules 1*c*, 1*b*, and is arranged beneath a module 1*d* and a further module (not shown).

In particular, each module 1*a* is superimposed on two mutually adjacent modules 1*c*, 1*b* and arranged beneath mutually adjacent halves of the module 1*d* and the further module (not shown).

Each module 1*a* (1*b*, 1*c*, 1*d*) essentially comprises:

a parallelepiped body 5; and a plurality of structural members 6*a* (6*b*, 6*c*, 6*d*).

More in detail, the body 5 comprises a lower face 8 and an upper face 9 opposite to each other and laying on respective horizontal planes which are parallel to each other in use.

The face 9 comprises a first and a second square relief 10, one of which engages a first groove (not shown) of a face 8 of the module 1*d* and the other of which engages a second groove of a lower face of the further module (not shown).

The face 8 comprises a first and a second square groove (not shown), one of which is engaged by a respective relief 10 of the module 1*c* and the other of which is engaged by a respective relief 10 of the module 1*d*.

The body 5 further comprises a pair of opposite faces 11 parallel to each other and vertically interposed between the faces 8, 9.

The body 5 finally comprises a pair of opposite faces 12 parallel to each other and vertically interposed between the faces 8, 9 and interposed between the faces 11.

The faces 11 and 12 define respective portions of mutually the opposite walls 2, 3 of the construction 4.

The following may be identified for each module 1*a* (1*b*, 1*c*, 1*d*) (FIG. 2):

a superimposition axis X of the modules 1*a*, 1*b*, 1*c*, 1*d* themselves arranged vertically in use; and a pair of axes Y, Z laying on face 9 and elongated along the projections of respective median symmetric planes of the respective module 1*a* (1*b*, 1*c*, 1*d*) itself.

Furthermore, axes Y, Z are orthogonal to each other and to axis X.

Advantageously, the members 6*a* (6*b*, 6*c*, 6*d*) are carried in fixed manner by the respective bodies 5.

In greater detail, the members 6*a* (6*b*, 6*c*, 6*d*) of each module 1*a* (1*b*, 1*c*, 1*d*) extend along the axes X of the respective modules 1*a* (1*b*, 1*c*, 1*d*) and form a two-dimensional casing 13 in a section obtained on an orthogonal plan P arranged horizontally in use.

The members 6*a*, 6*b*, 6*c*, 6*d* are fixed to the body 5 at the extensions of the vertexes of the relief 10 itself.

In other words, the casing 13 extends on the plane P defined in directions X, Y in the aforesaid section.

Furthermore, the members 6*a* (6*b*, 6*c*, 6*d*), and thus the casing 13, extend about the projection G of the centre of gravity of the respective module 1*a* (1*b*, 1*c*, 1*d*) on the plane P (FIG. 2).

More in particular, the members 6*a* (6*b*, 6*c*, 6*d*) are carried by the faces 11, 12 of the respective module 1*a* (1*b*, 1*c*, 1*d*).

By virtue of such a configuration, the casing 13 defines an intrados and an extrados with respect to the loads generated by the weight and the working loads of the construction 4.

Consequently, by virtue of such a configuration, the casing 13 supports both the traction forces and the compression forces deriving from the weight and the working loads of the construction 4.

Figure 3:
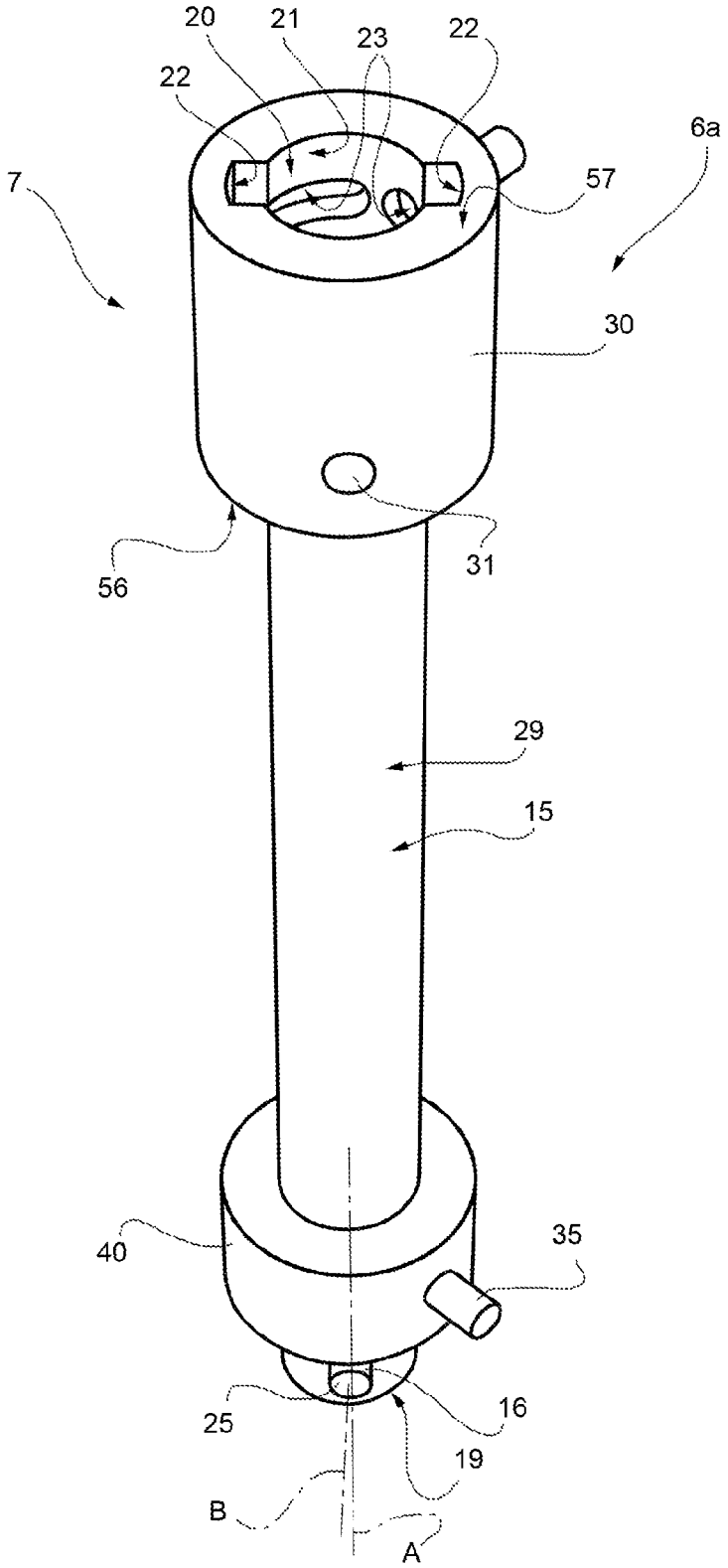
FIG. 3 shows some components of the module in FIGS. 1 and 2 on a highly magnified scale.
Figure 4:
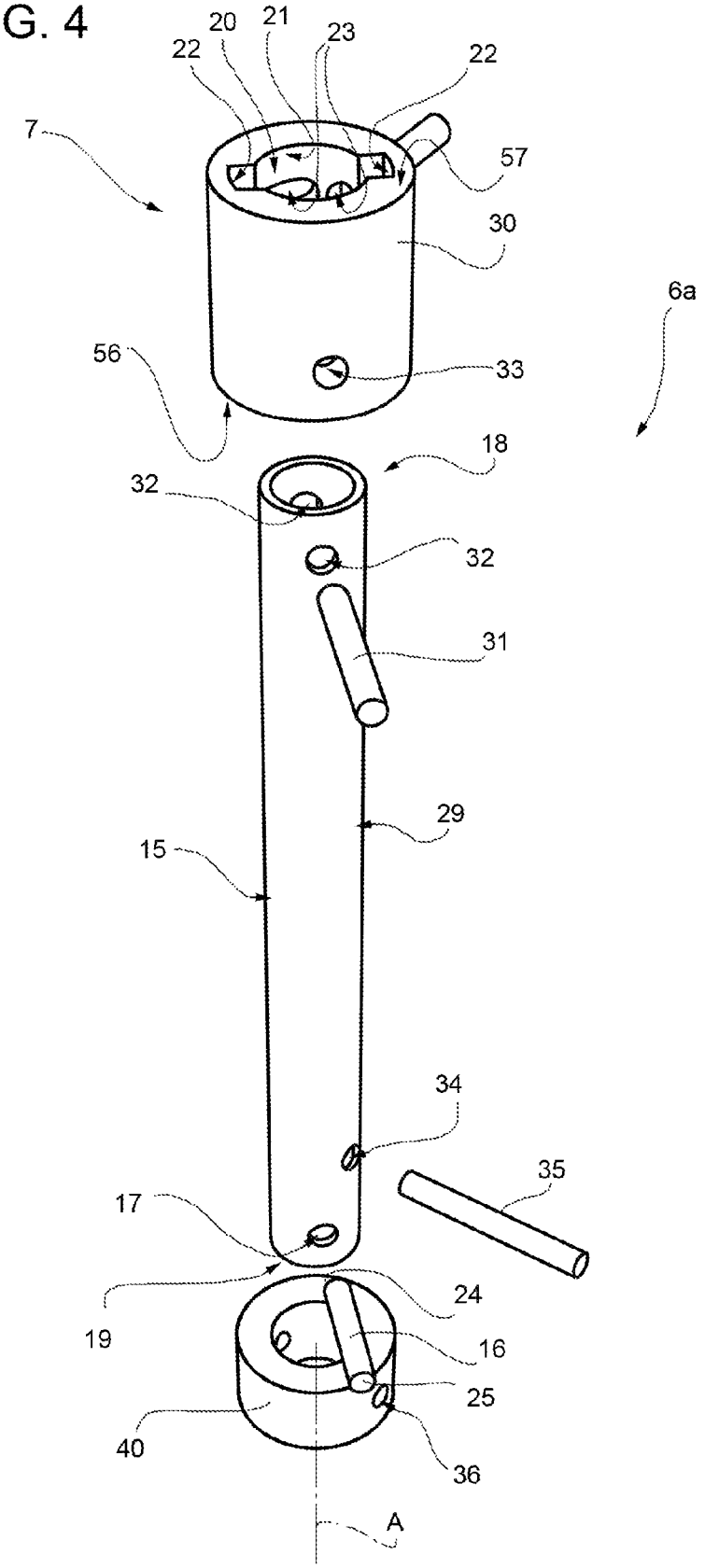
FIG. 4 is an exploded view of the components in FIG. 3.
Figure 5:
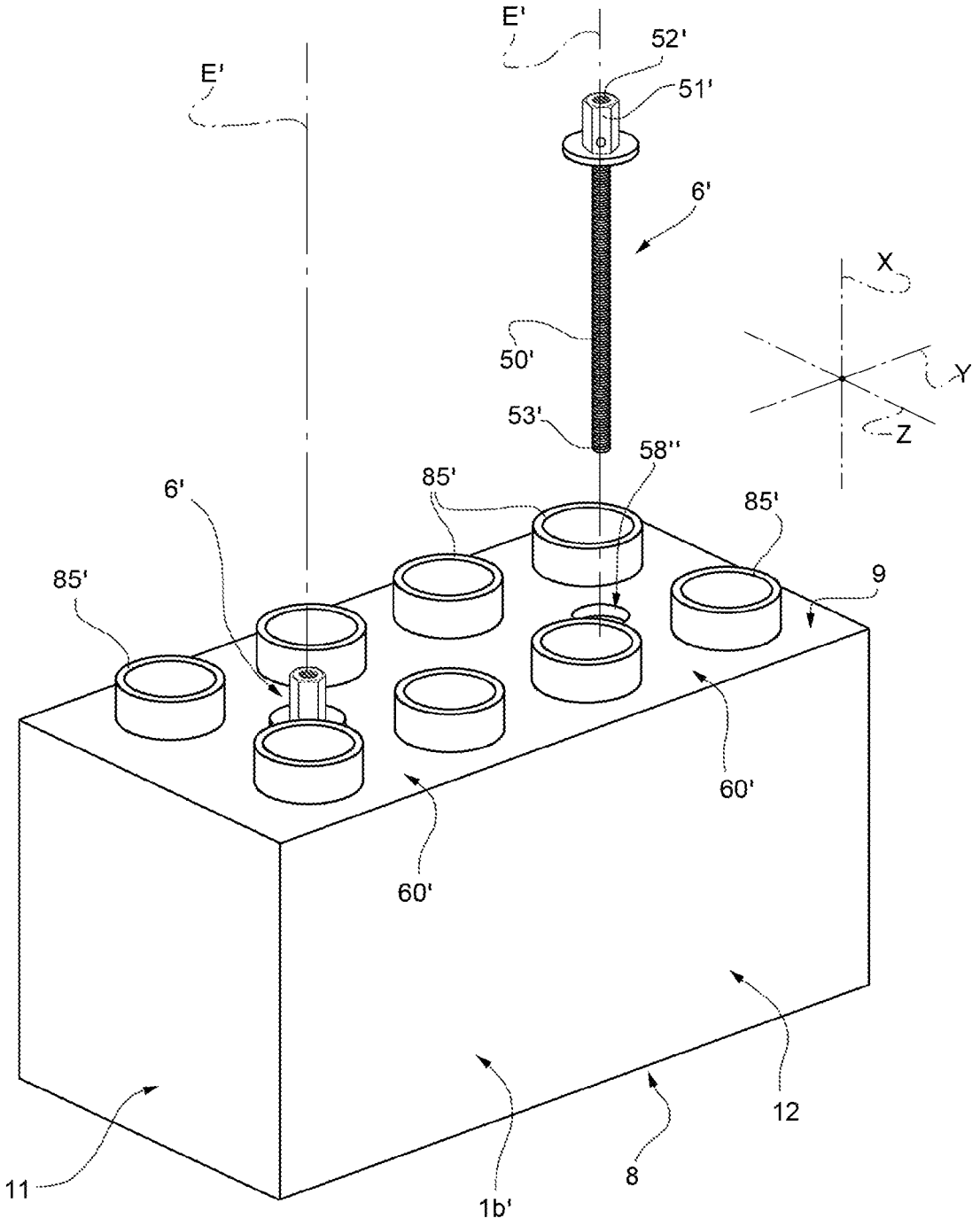
FIGS. 5 and 6 are perspective views from the top and bottom of a reusable module according to a second embodiment of the present invention, respectively.

The member 6*a* comprises (FIGS. 3 and 4), in particular:

a stem 15 elongated along an axis A parallel to the axis X; and a pin 16 connected to the stem 15 and crossing two holes 17 of the stem 15 itself.

In particular, the stem 15 is cylindrical, has axis A and a first and a second axial end 18, 19 opposite to each other.

The axial end 18 faces the module 1*d* and is thus arranged above in use.

The axial end 19 faces the modules 1*c*, 1*b* and is thus arranged below in use.

The pin 16 is elongated along an axis B orthogonal to axis A and protrudes radially from axis A.

The holes 17, and thus the pin 16, are arranged in interposed position between the axial ends 18, 19 and closer to the axial end 19.

Each module 1*a*, 1*b*, 1*c*, 1*d* comprises a plurality of restraining members 7, each of which connects a respective member 6*a* of the module 1*a* to a corresponding member 6*b*, 6*c*, 6*d* of the module 1*b*, 1*c*, 1*d* or of the further module (not shown) in releasable manner.

The restraining members 7 are arranged at the vertexes of the relief 10.

The restraining member 7 adapted to connect one of the members 6*b* of module 1*b* to the corresponding member 6*a* of module 1*a* is described by way of example in this description.

Each restraining member 7 is configured so as to;

allow the sliding along axis A of the member 6*b* of the module 1*b* relatively to the member 6*a* of the module 1*a* to a first angular insertion position of the member 6*b* of the module 1*b* inside the restraining member itself;

allow the rotation about axis A of member 6*b* with respect to member 6*a* to a second insertion position starting from the first angular insertion position; and prevent the relative sliding of the members 6*a*, 6*b* along said first axis A in the second insertion position.

In particular, the restraining member 7 defines a seat 20 which can be snap-locked by the pin 16 of the member 6*b* of the module 1*b*.

More specifically, the restraining member 7 is connected to the stem 15 in position adjacent to the axial end 18.

In the illustrated case in point, the restraining member 7 is tubular and has a greater diameter than that of the stem 15.

The seat 20 defines a cavity 21 of axis A engaged by the axial end 19 of the stem 15 of the module 1*b*.

The seat 20 further comprises:

a pair of grooves 22 arranged radially with respect to the cavity 21, open axially in direction parallel to axis A and engaged by opposite radial ends 24, 25 of the pin 16 of the stem 15 of the module 1*b* in a step of inserting/extracting the aforesaid stem 15 in/from the module 1*b* arranged in the first angular insertion position with respect to axis A; and a pair of grooves 23 axially closed in direction parallel to axis A, angularly adjacent and offset with respect to the corresponding grooves 22 and snap-locked by the respective ends 24, 25 of the pin 16 of the stem 15 of the module 1*b* in a step of locking of the stem 15 arranged in the second angular insertion position with respect to axis B.

In other words, the stem 15 of the module 1*b* is arranged in the first angular insertion position and inserted in the seat 20 parallel to axis A, so that the ends 24, 25 of the pin 16 engage the respective grooves 22.

Afterwards, the stem 15 is turned about axis A so that the ends 24, 25 of the pin 16 snap-lock the grooves 23.

By virtue of the fact that the aforesaid grooves 23 are axially closed, the extraction of the stem 16 parallel to axis A is prevented when the stem 15 itself is arranged in the second angular position.

In the illustrated case in point, the stem 15 is hollow and smooth, i.e. is not threaded on a surface 29 thereof.

The restraining member 7 further comprises a collar 30 defining the seat 20 connected to the stem 15 of the module 1*a*.

In greater detail, the collar 30 is connected to the stem 15 by means of a pin 31 (FIGS. 3 and 4) extending radially to axis A. In particular, the pin 31 engages a pair of through circular seats 32 defined by the stem 15 itself and a pair of circular through seats 33 defined by the collar 30 and superimposed in the respective seats 32.

The diameter of the collar 30 is greater than that of the stem 15 and the collar 30 surrounds the stem 15 itself in position adjacent to the axial end 18 of the stem 15.

The collar 30 comprises (FIG. 4) a lower face 56 and an upper face 57 opposite to each other.

Advantageously, face 57 is arranged in contact with the module 1*a* (1*d*) arranged above.

Face 56 is arranged in contact with the module 1*b*, 1*c* (1*a*) arranged below.

In this manner, the vertical compression load due to the proper weight of the walls 2, 3 or to further vertical forces applied to the construction 4 are transmitted from the module 1*a* (1*d*) arranged above to the collar 30, and from there to the stems 15 of the module 1*b* (1*c*) arranged below.

Each member 6*a* further comprises a collar 40, the diameter of which is greater than that of the stem 15 and which surrounds the stem 15 itself in position adjacent to the axial end 19.

The collar 40 is connected to the stem 15 by means of a pin 35 (FIG. 3), which extends radially to axis A.

A pin 35 engages a pair of circular through seats 34 defined by the stem 15 and a pair of circular through seats 36 defined by the collar 40.

The seats 36 are superimposed on the respective seats 34.

In particular, the seats 34 are interposed between the pin 16 and the seats 32 along axis A and are circumferentially offset with respect to the seats 32 about axis A.

The collar 30 of each member 6*a* (6*b*, 6*c*, 6*d*) abuts against the collar 40 of the member 6*b* (6*a*, 6*c*, 6*d*) to which it is connected when the aforesaid members 6*a*, 6*b* were connected to each other by inserting the pin 16 of the member 6*b* (6*a*, 6*c*, 6*d*) into the grooves 23 of the restraining member 7.

In particular, the body 5 may be made of any one of the following materials: plastic, in particular PVC, nylon, Plexiglas, recycled plastic, or wood, brick or concrete.

In this manner, the walls 11, 12 define a lining of the building 4 without needing further machining and/or interventions thereon.

Furthermore, the body 5 comprises (FIGS. 1 and 2):

a through hole 48, which extends between the faces 8 and 9 and has an axis parallel to the axes A, X; and a through hole 49, which extends between the faces 11 and has an axis parallel to axis Y.

The holes 48, 49 extend, in particular, orthogonal to faces 8, 9, and 11, respectively.

The holes 48, 49 are circular, in the illustrated case in point.

The respective holes 48, 49 are superimposed and communicate with one another once the modules 1*a*, 1*b*, 1*c*, 1*d* and the further module are connected to one another.

In particular, the holes 48 superimposed on one another define a first duct arranged vertically in use. Similarly, the holes 49 superimposed on each other define a second duct arranged horizontally in use.

The aforesaid ducts define respective housings for technological networks, such as for example hydraulic or electric networks.

In use, the construction 4 is made by arranging the modules 1*a*, 1*b*, 1*c*, 1*d* so as to form the walls 2, 3.

Each module 1*a* is connected to the modules 1*b*, 1*c*, 1*d* firstly by restraining the relieves 10 into the corresponding grooves (not shown) of the modules 1*b*, 1*c*, 1*d*.

Afterwards, the members 6*a* of the module 1*a* are connected to the corresponding members 6*b*, 6*c*, 6*d* of the modules 1*b*, 1*c*, 1*d* by means of the restraining members 7.

In greater detail, the collar 30 of each restraining module 7 is fixed to the respective stem 15 of the module 1*a* by virtue of the respective pin 31 which engages the seats 32 of the stem 15 itself.

Hereinafter, the present description describes how a member 6*a* is connected to the corresponding member 6*b* by way of example.

In greater detail, the stem 15 of the member 6*b* is arranged in the first angular position and inserted parallel to axis A in the seat 20. At the end of such an insertion, the axial end 19 (arranged underneath in use) of the aforesaid stem 15 is inserted in the cavity 21 of the seat 20 of the restraining member 7.

More specifically, in the first angular position of the stem 15, the ends 24, 25 of the pin 16 engage the grooves 22 of the seat 20.

Hereinafter, the stem 15 is turned about axis A to reach the second angular position in which the ends 24, 25 of the pin 16 snap-lock the grooves 23 in the seat 20.

The extraction of the stem 15 from the member 6*b* is prevented by virtue of the fact that the grooves 22, 23 are axially closed.

The collar 30 of the member sa is abuttingly arranged against the collar 40 of the member 6*b* once the pin 16 of the member 6*b* is locked inside the grooves 24, 25 of the restraining member 7.

The further members 6*a* of the module 1*a* are connected to the corresponding further members 6*b* of the module 1*b* in manner similar to that described above so as to fix module 1*b* to module 1*a* in stable manner.

Similarly to what described above, module 1*a* is fixed to modules 1*c*, 1*d* and to the further module so as to form the construction 4. Once the construction 4 is formed, the members 6*a*, 6*b*, 6*c*, 6*d* form the casing 13 of the construction 4 itself.

Furthermore, once the construction 4 is formed, the holes 48, 49 define the first and the second duct, respectively, which may be used to accommodate the technological networks, such as for example the hydraulic or electric utility networks of the construction 4 itself.

The traction and compression loads generated by the weight and the working loads of the construction 4 are supported by the casing 13, i.e. by the members 6*a*, 6*b*, 6*c*, 6*d* of the modules 1*a*, 1*b*, 1C, 1*d*.

Furthermore, the casing 13 defines both an intrados and an extrados which withstand the aforesaid compression and traction loads.

Furthermore, by virtue of the fact that the faces 57 of the collars 30 of the modules 1*b* (1*c*) arranged below are in contact with the faces 8 of the modules 1*a* (1*d*) arranged above, the vertical downward compression loads are transmitted by the module 1*a* (1*d*) arranged above to the stems 15 and must not therefore be supported by the bodies 5.

The modules 1*a*, 1*b*, 1*c*, 1*d* are disassembled from one another when the construction needs to be dismounted.

By way of example, the module 1*b* is disassembled from the module 1*a*, by releasing the members 6*b* from the corresponding members 6*a* and, afterwards, by moving the module 1*b* away from the module 1*a* so as to release the grooves (not shown) of the module 1*b* from the relieves 10 of the module 1*a*.

More in detail, each member 6*b* is turned about axis A from the second angular position to the first angular position, so as to remove the ends 24, 25 of the pin 16 from the corresponding grooves 23 of the seat 20 and to accommodate the aforesaid ends 24, 25 of the pin 16 in the corresponding grooves 22 of the seat 20.

At this point, each member 6*b* is extracted in direction parallel to the respective axis A from the seat 20 of the respective restraining member 7.

In figures from 5 to 7, reference numerals 1*a*', 1*b*' indicate a reusable module according to a second embodiment of the present invention.

Figure 7:
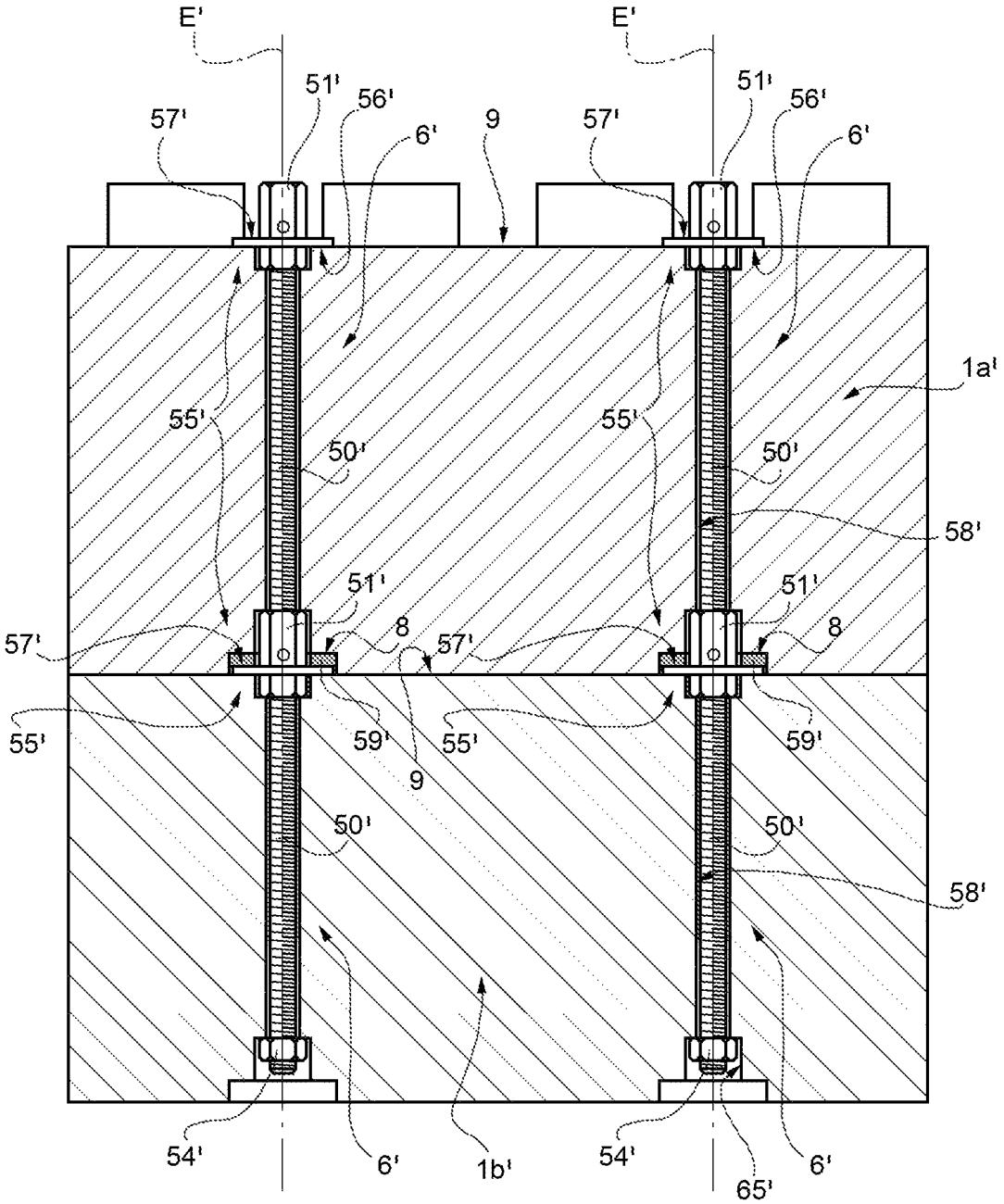
FIG. 7 is a section view of a portion of construction comprising a plurality of reusable modules according to a second embodiment of the present invention.

In FIG. 7, module 1*b*' is arranged below module 1*a*'.

Module 1*a*', 1*b*' is similar to module 1*a*, 1*b*, 1*c*, 1*d* and only the differences will be described; corresponding or equivalent parts of modules 1*a*', 1*b*' and 1*a*, 1*b* will be indicated by the same reference numbers where possible.

In particular, module 1*a*', 1*b*' differs from module 1*a*, 1*b*, 1*c*, 1*d* in that it comprises a pair of structural members 6' and a pair of through holes 58' adapted to be engaged by respective structural members 6'.

In particular, the structural members 6' and the holes 58' extend along respective axes E' parallel to direction X.

Each structural member 6' is arranged within a respective half 60' of the respective module 1*a*', 1*b*'.

Each axis E' defines a symmetry axis of the respective half 60' of the corresponding module 1*a*', 1*b*', and lays on a middle plane of the module 1*a*', 1*b*' equally distanced from the faces 12 of the module 1*a*', 1*b*' itself.

Each structural member 6' comprises:

- a threaded stem 50' elongated along an axis E' parallel to direction X and accommodated with clearance in the hole 58';
- a head 51' defining an end arranged above the stem 50' in use and defining a nut screw 52';
- an end 53' axially opposite to head 51'.

In the illustrated case in point, the diameter of the head 51' is greater than the diameter of the stem 50'.

The stems 50' of the modules 1*b*' defining a lower row of the wall 2, 3 have respective ends 53' screwed into a nut 54' the diameter of which is greater than that of the hole 58" (FIG. 7).

The nut 54' fixes each member 6' to the respective module 1*a*', 1*b*'.

The stems 50' of the modules 1*a*' are superimposed over the modules 1*b*', (1*a*') have the respective ends 53' screwed into the nut screws 52' of the heads 51' of the screws 50' associated to the modules 1*b*' (1*a*').

Each stem 50' comprises a flange 55' transversally protruding from the axis E' having a lower face 56' in use and an upper face 57' in use opposite to face 56'.

In the illustrated case in point, the diameter of the flange 55' is 1.5 times greater than the diameter of the head 51', and preferably equal to twice the diameter of the head 51'.

Advantageously, the face 57' is arranged in contact, either directly or indirectly, with the face 8' of the module 1*a*' arranged above.

The face 56' is arranged in contact, either directly or indirectly, with the module 1*b*' arranged below.

In such a manner, the downward loads and the loads due to the weight of the walls 2, 3 or to the load bearing on the construction 4 on the walls themselves is distributed by the modules 1*a*' (and by the modules superimposed thereon) and on the members 6' making the member 6' itself collaborate in the mechanical strength of the construction, similarly to the behavior of steel casing and concrete in reinforced concrete structures.

In greater detail, each flange 55' extends orthogonally to axis E'.

More specifically, each flange 55' protrudes from the head 51'.

Each flange 55' is further interposed between the face 9 of the module 1*b*' arranged below and the face 8 of the module 1*a*' arranged above.

More specifically, a ring 59' made of elastic material or with a corrugated surface and having locking function is interposed (FIG. 7) between the face 57' of the member 6' and the face 8 of the module 1*a'* arranged above.

In addition to preventing the loosening of the stem 50' of the upper connection member 6' from the head 51' of the lower connection member 6', the ring 59' transmits the load from the face 8 of the module 1*a'* to the flange 55' of the lower connection member 6'.

Figure 6:
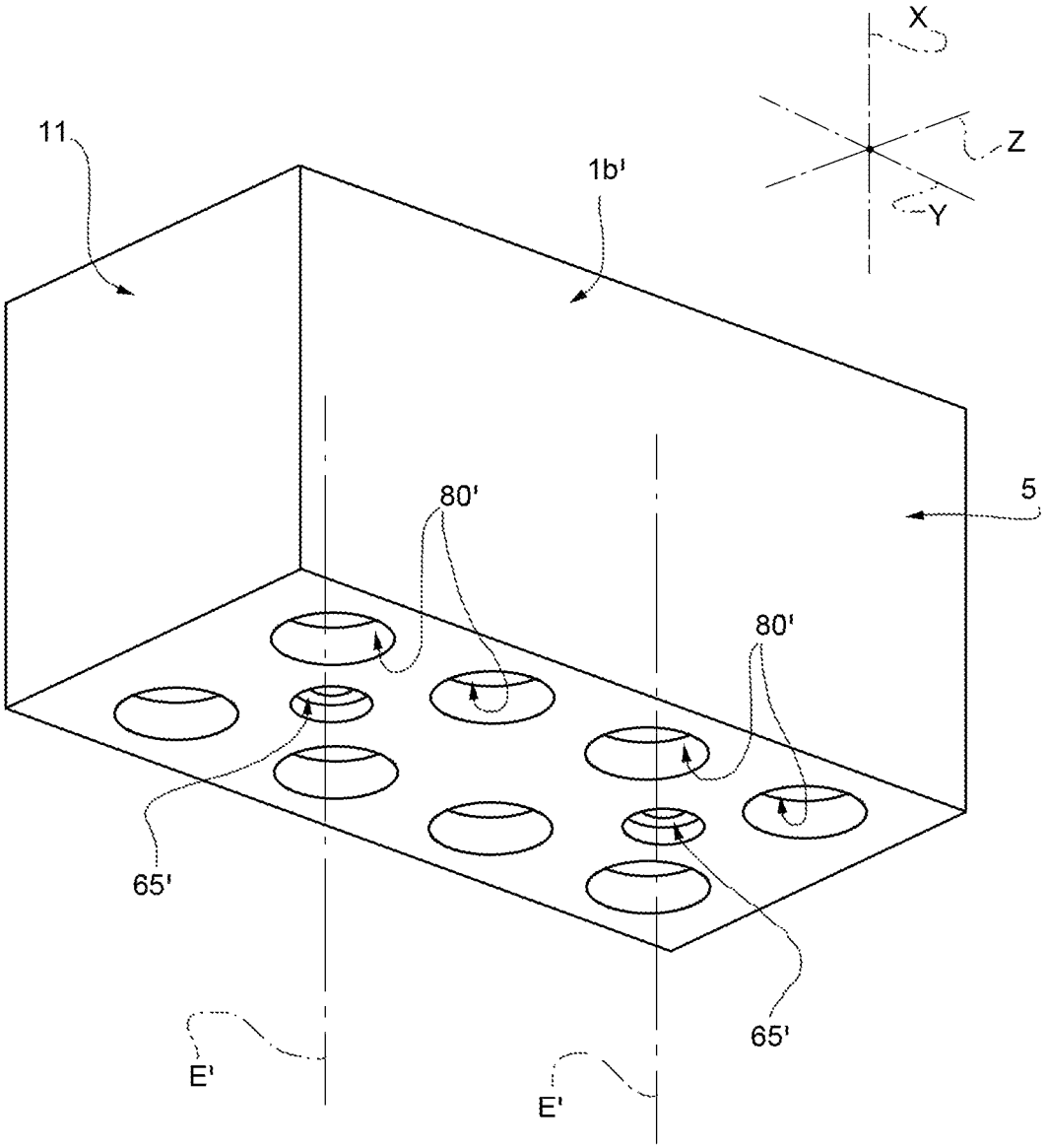

Each module 1*a'*, 1*b'* further differs from the module 1*a*, 1*b*, 1*c*, 1*d* in that it comprises a pair of cavities 65' with cylindrical axis E' open at the face 8 thereof (FIGS. 6 and 7).

The cavities 65' are contiguous to the holes 58' and are adapted to accommodate the heads 51' of the screws 50' associated to the lower modules or to the nuts 54'.

Furthermore, the module 1*a'*, 1*b'* differs from the module 1*a*, 1*b*, 1*c*, 1*d* in that it comprises a plurality, four in the case in point, of through holes 80' having respective axes parallel to axis E for each half 60*a'*.

The holes 80' are arranged symmetrically about axis E' of the respective half 60' and according to two rows parallel to each other and to direction Y.

The modules 1*a'*, 1*b'* are connected to one another by means of a plurality of connection members 85' extending parallel to the axes E' and engaging half of the respective holes 80' of the module 1*b'* and half of the respective holes 80' of the module 1*a'*.

In the illustrated case in point, the connection members 85' are made of plastic material, preferably PVC.

The operation of the module 1*a'*, 1*b'* is essentially identical to the operation of the module 1*a*, 1*b*, 1*c*, 1*d* and is therefore not described in detail.

Figure 8:
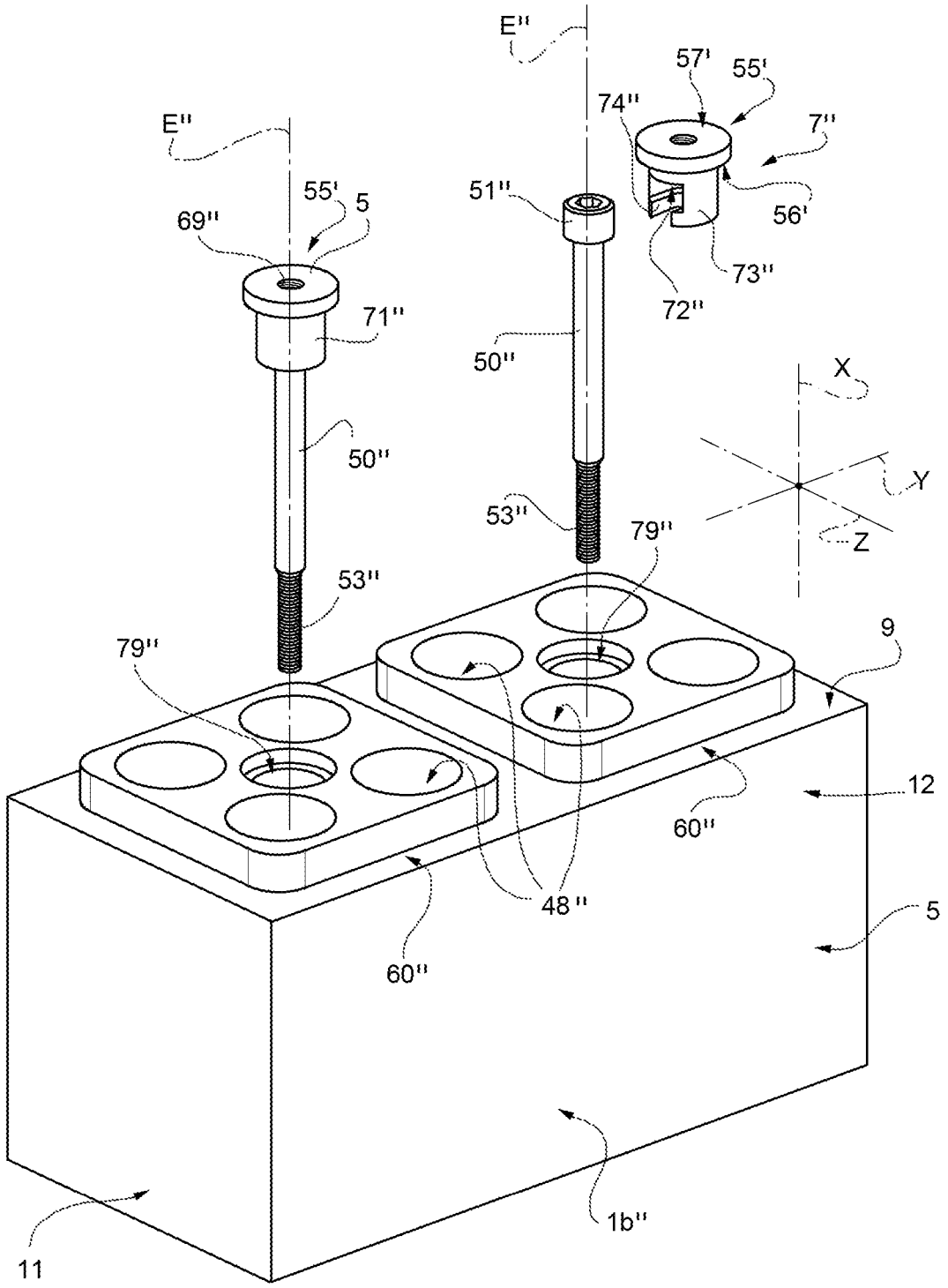
FIGS. 8 and 9 are perspective views from the top and bottom of a reusable module according to a third embodiment of the present invention, respectively.
Figure 9:
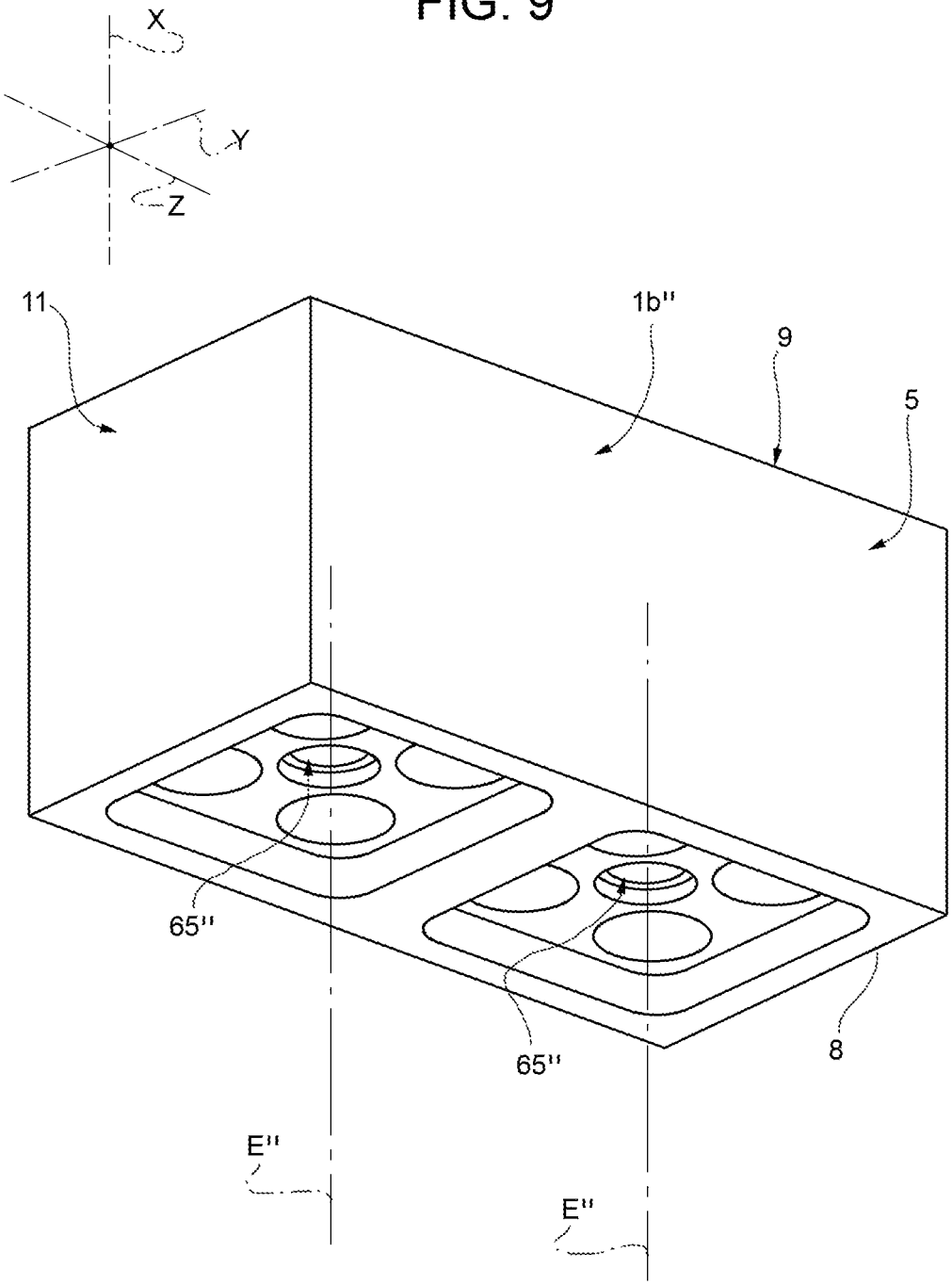
Figure 10:
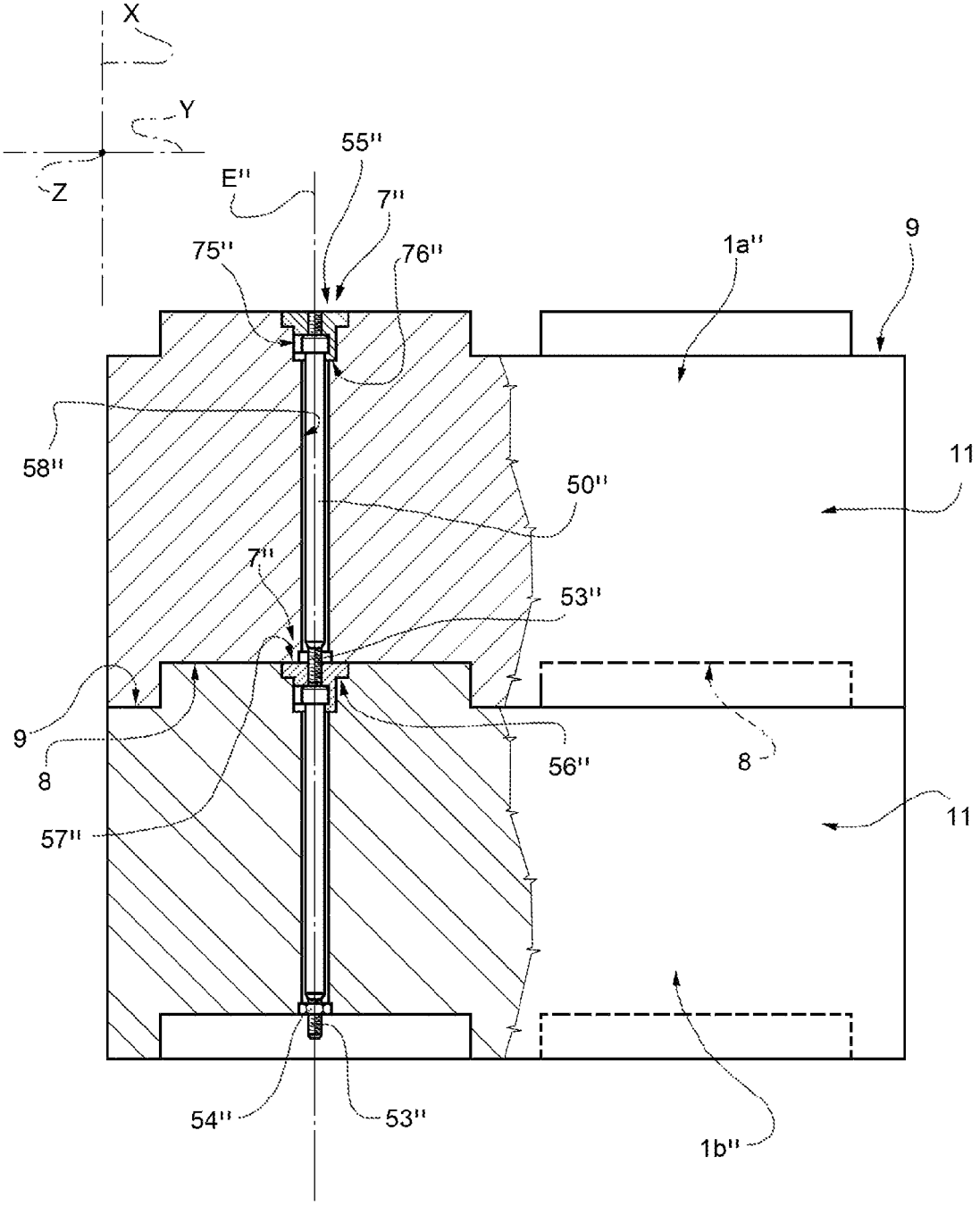
FIG. 10 is a section view of a portion of construction comprising a plurality of reusable modules according to a third embodiment of the present invention.

In FIGS. 8, 9 and 10, reference numerals 1*a*", 1*b*" indicate a reusable module according to a third embodiment of the present invention.

Module 1*a*", 1*b*" is similar to module 1*a'*, 1*b'* and only the differences will be described; corresponding or equivalent parts of modules 1*a*", 1*b*" and 1*a'*, 1*b'* will be indicated by the same reference numbers where possible.

Module 1*a*", 1*b*" differs from module 1*a'*, 1*b'* in that each structural member 6" comprises:

- a stem 50" elongated along axis E" adapted to be accommodated in the hole 58";
- a head 51" defining an axial end of larger diameter arranged above the stem 50" in use; and
- a threaded portion 53" defining an axial end of the stem 50" opposite to the head 51".

The stem 50", the head 51" and the portion 53" are defined by a single member in the illustrated case in point.

In the illustrated case in point, the diameter of the stem 50" is smaller than the diameter of the head 51". The diameter of the stem 50" is, in turn, greater than the diameter of the portion 53".

The module 1*a*", 1*b*" differs from the module 1*a'*, 1*b'*, in that it comprises a plurality of restraining members 7" each adapted to connect two structural members 6" superimposed on each other, and hereinafter named upper and lower structural member 6".

In particular, each restraining member 7" comprises:

- a flange 55" defining a threaded hole 69" of axis E" adapted to be engaged by the portion 53" of the upper structural member 6"; and
- a body 71" protruding beneath from the flange 55" having diameter smaller than the flange 55" itself and defining a seat 72" for the head 51" of the lower structural member 6".

In particular, the body 71" comprises:

- a wall 73" overhangingly protruding from the flange 55", having extension parallel to axis E" and extending annularly about axis E" for less than 360 degrees so as to define an opening 75" of the seat 72" offset with respect to axis E"; and
- a wall 74" orthogonal to axis E" and defining a U-shaped opening 76*r* delimiting the seat 72" on the side axially opposite to the flange 55".

The dimensions of the opening 76" are smaller than the diameter of the head 51" and greater than the diameter of the stem 50" in direction radial to axis E".

The member 6" carried by the lower module 1*b*" is coupled to the restraining member 7", by inserting the head 51" in the seat 72" by means of the opening 75" and by axially locking the head 51" against the wall 74".

Afterwards, the portion 53" of the member 6" carried by the upper module 1*a*" is screwed into the member of the threaded hole 69", thus making the upper and lower members 6" integral.

The flange 55" of each restraining member 7" comprises a face 56" arranged above in use and a face 57" arranged below in use (FIG. 10).

Advantageously, the face 57" is arranged in contact with the module 1*a*" (FIG. 10) arranged above.

The face 56" is arranged in contact with the upper face 9 of the module 1*b*" arranged below.

In particular, the lower face 56" is in contact with a seat 73" defined by the upper face 9" of the module 1*b*".

The upper face 57" is in contact with the lower face 8" of the module 1*a*".

The module 1*a*", 1*b*" further differs from the module 1*a'*, 1*b'* in that it comprises a plurality, four in the case in point, of holes 48" defining respective vertical, ducts for each half 60".

The holes 48" are arranged symmetrically about axis E" of the respective half 60" and according to two rows parallel to each other.

Furthermore, each member 6" is preferably fixed to the respective module 1*a*", 1*b*" by interposing a nut 53".

The operation of the module 1*a*", 1*b*" is essentially identical to the operation of the module 1*a*, 1*b*, 1*c*, 1*d* and is therefore not described in detail.

The advantages that the present invention allows to obtain are apparent from an examination of the module 1*a*, 1*b*, 1*c*, 1*d*; 1*a'*, 1*b'*; 1*a*", 1*b*".

In particular, the collar 30 (flange 55', 55") comprises a face 57, 57', 57" cooperating, either directly or indirectly, with the module 1*a*, 1*b*, 1*c*, ad; 1*a'*, 1*b'*; 1*a*", 1*b*" arranged above.

Therefore, the downward loads due, for example, to the weight of the wall 2, 3 are transmitted by the module 1*a*, 1*b*, 1*c*, 1*d*; 1*a'*, 1*b'*; 1*a*", 1*b*" to the collar 30 (55', 55") and are transmitted from the latter to the member 6*a*, 6*b*, 6*c*, 6*d*; 6', 6" thus engaging the module 1*a*, 1*b*, 1*c*, 1*d*; 1*a'*, 1*b'*; 1*a*", 1*b*".

In this manner, the module 1*a*, 1*b*, 1*c*, 1*d*; 1*a'*, 1*b'*; 1*a*", 1*b*" does not need to perform any load-bearing functions and may be made of a material with mediocre mechanical properties, thus making it possible to use materials with particular cosmetic or soundproofing or thermal insulation properties. In this manner, the flexibility of the constructions 4 which can be made with the module 1*a*, 1*b*, 1*c*, 1*d* is much greater than in the solution described in patent application WO2009/104047.

Consequently, the flexibility of the constructions 4 which can be made with the module 1*a*, 1*b*, 1*c*, 1*d*; 1*a'*, 1*b'*; 1*a*", 1*b*" is much greater than in the solution described in patent application WO2009/104047.

Indeed, the diameter of the collar 30 (flange 55, 55') is considerably greater than the diameter of the head of the tie-rods described in patent application 2009/104047, and the collar 30 (flange 55, 55') may consequently withstand and distribute a greater load to the member 6*a*, 6*b*, 6*c*, 6*d*; 6', 6".

In particular, the bodies 5 may be made with a cosmetic finish on the faces 11 and/or 12, so that the construction 4 may be readily finished. This is particularly advantageous when the construction 4 is intended for a use very different from that of a construction, e.g. for a walk-in closet, a sliding construction on wheels or for assembling a trade show stand.

Furthermore, the body 5 carries the member 6*a*, 6*b*, 6*c*, 6*d*; 6', 6" in fixed manner.

By virtue of this, it is possible to make constructions 4 of particularly articulate, imaginative shape, also in fields different from constructions.

Differently, the solution described in patent application WO2009/104047 includes the use of tie-rods not carried by the modules, but accommodated inside the holes of the modules themselves and interposed between superimposed rows of modules.

Therefore, the solution described in patent application WO2009/104047 allows to essentially make regular walls of conventional type.

Furthermore, the connection members 85' allow to connect the modules 1*a*, 1*b*, 1*c*, 1*d*; 1*a'*, 1*b'*; 1*a"*, 1*b"* to one another without requiring protrusions obtained directly on the body 5.

Furthermore, the members 6*a*, 6*b*, 6*c*, 6*d* form the casing 13, which extends from both sides of the axes Y, Z of symmetry of the module 1*a*, 1*b*, 1*c*, 1*d*.

Consequently, the members 6*a*, 6*b*, 6*d*, 6*d* are located at the intrados and the extrados of the wall 2, 3. Consequently, the casing 13 can withstand both traction forces and compression forces generated by the weight and the working load of the wall 2, 3.

By virtue of the presence of the holes 48, 49, 48", the wall 2, 3 may accommodate the technological networks in the respective first and second duct.

By virtue of the presence of the restraining members 7, the construction 4 is easy to assemble and disassemble, without requiring specialized manpower and without producing waste, dust or rubble.

It is finally apparent that changes and variants can be made to the module 1*a*, 1*b*, 1*c*, 1*d*; 1*a'*, 1*b'*; 1*a"*, 1*b"* described and illustrated herein without departing from the scope of protection of the present invention.

In particular, the module 1*a*, 1*b*, 1*c*, 1*d*; 1*a"*, 1*b"* may be provided with connection members 85' and respective holes 80', instead of relieves 10.

The module 1*a'*, 1*b'* may comprise the holes 48, 48".

The invention claimed is:

1. A dismountable reusable module for manufacturing at least one portion of a repeatably dismountable wall of a construction, comprising:

a first body adapted to define an outer surface of said wall, said first body having an upper face and an opposite lower face; and at least one structural member adapted to withstand loads generated by said wall;

said structural member comprising a main body elongated along a first axis, arranged vertically in use, a head having a first diameter, and a thickening having a second diameter protruding from said main body transversally to said first axis;

said thickening defining:

a first face; and a second face opposite to said first face;

wherein said first face of said thickening rests directly atop said upper face of said first body;

wherein said second face of said thickening is adapted to cooperate with a further module, superimposable on said module according, to said first axis, said thickening being directly connected to said main body so as to be axially fixed relative to said main body along said first axis so that a downwards load transmitted from said further module to said thickening is transmitted from said thickening to said main body; and wherein said second diameter is at least 1.5 times greater than said first diameter.

2. A module according to claim 1, wherein said first face cooperates, either directly or indirectly, with said module.

3. A module according to claim 2, wherein said first face comes into contact with said module and said second face comes into contact with said further module.

4. A module according to claim 1, wherein said module can be coupled to said further module without using a casting of binding material.

5. A module according to claim 1, wherein said first body defines a through passage, which can be crossed by technological networks and is arranged adjacent to a further passage of said further module, when said module and said further module are connected to each other by said structural member.

6. A module according to claim 1, wherein said first body is made of wood, brick, concrete, or a plastic material selected from PVC, nylon, Plexiglas, and recycled plastic.

7. A module according to claim 1, further comprising:

at least one first through hole extending through the first body from the upper face to the lower face, the structural member positioned within the first through hole;

at least one second through hole extending through the first body from the upper face to the lower face; and a connection member distinct from said module located partially within the second through hole so that a portion of the connection member protrudes from the upper face of the first body, and wherein the portion of the connection member is positioned within an opening in a lower face of said further module to couple said module to said further module.

8. A module according to claim 7, wherein said connection member is a ring-shaped member having an inner surface that defines a hollow interior.

9. A module according to claim 1, wherein said thickening is non-rotatably coupled to said main body.

10. A module according to claim 1, wherein said structural member comprises:

a stem engaging a first hole of said module; and a threaded portion arranged on mutually opposite axial ends of said stem;

the first diameter of said head being larger than a diameter of said stem;

said first hole being couplable with said threaded portion of a further structural member carried by said further module.

11. A module according to claim 10, wherein said head defines a nut screw which can be coupled with said threaded portion of said further structural member.

12. A module according to claim 1, wherein said thickening is distinct from said head.

13. A module according to claim 1, wherein said thickening is defined by a flange resting on a face of said module.

14. A module according to claim 1, further comprising an elastic ring abutting against said second face of said thickening and located between said second face of said thickening and said further module.

15. A dismountable reusable wall comprising:

a module according to claim 1; and at least one further module.

16. A module according to claim 1 wherein said upper face of said first body lies on a first horizontal plane and said lower face of said first body lies on a second horizontal plane that is parallel to said first horizontal plane, said upper and lower faces of said first body forming uppermost and lowermost surfaces of said module.

17. A module according to claim 16 further comprising a through hole extending through said first body from said upper face to said lower face, said structural member positioned within said through hole.

18. A module according to claim 17 wherein said through hole comprises a first portion having a first cross-sectional area, a second portion positioned between said first portion and said upper face of said first body and having a second cross-sectional area, and a third portion positioned between said first portion and said lower face of said main body and having a third cross-sectional area, wherein each of said second and third cross-sectional areas is greater than said first cross-sectional area, and wherein said main body of said structural member is located within said first portion of said through hole, said structural member further comprising an annular protuberance extending from said main body transversally to said first axis such that said head is adjacent to and extends from said second face of said thickening and said annular protuberance is adjacent to and extends from said first face of said thickening, and wherein said annular protuberance of said structural member is located within said second portion of said through hole.

19. A module according to claim 18 wherein said through hole is defined by a vertical surface defining said first portion of said through hole, and a riser surface and a tread surface that collectively define said second portion of said through hole, said riser surface extending from said upper face of said first body to said tread surface and said tread surface extending from said riser surface to said vertical surface.

20. A module according to claim 16 wherein said first face of said thickening lies on a third horizontal plane that is parallel to each of said first and second horizontal planes and does not intersect any portion of said first body.

21. A module according to claim 1 wherein said thickening is adapted to cooperate with a surface of said further module without said structural member penetrating said surface of said further module.

22. The module according to claim 1 wherein the structural member further comprises an annular protuberance extending from said main body transversally to said first axis, wherein said head is adjacent to and extends from said second face of said thickening and said annular protuberance is adjacent to and extends from said first face of said thickening.

23. The module according to claim 1 wherein said main body and said thickening of said structural member are integrally formed as a monolithic component.

24. The module according to claim 1 wherein said structural member is a monolithic component comprising each of the main body, the thickening, and the head.

25. A dismountable reusable module for manufacturing at least one portion of a repeatably dismountable wall of a construction, comprising:

a first body adapted to define an outer surface of said wall, said first body comprising an upper surface and an opposite lower surface;

a first plurality of through holes extending through the first body from the upper surface to the lower surface;

a connection member positioned within each of the first plurality of through holes so that a first portion of the connection member is located between the upper and lower surfaces of the first body and a second portion of the connection member protrudes from the upper surface of the first body;

a second plurality of through holes extending through the first body from the upper surface to the lower surface;

a structural member adapted to withstand loads generated by said wall positioned within each of the second plurality of through holes;

said structural member comprising a main body elongated along a first axis, arranged vertically in use, a head, and a thickening, protruding from said main body transversally to said first axis, said thickening being directly affixed to said main body so as to be axially fixed relative to said main body along said first axis;

said thickening defining:

a first face; and a second face opposite to said first face;

wherein said first face of said thickening rests atop said upper face of said first body;

wherein said second face of said thickening is adapted to cooperate with a further module, superimposable on said module according to said first axis, so that a downwards load of said further module is transmitted to said thickening and from said thickening to said main body of said structural member; and wherein said thickening is adapted to cooperate with a surface of said further module without said structural member penetrating said surface of said further module.

26. A dismountable reusable module for manufacturing at least one portion of a repeatably dismountable wall of a construction, comprising:

a first body adapted to define an outer surface of said wall, said first body having a upper face and an opposite lower face; and at least one structural member adapted to withstand loads generated by said wall;

said structural member comprising a main body elongated along a first axis, arranged vertically in use, a head having a first diameter and directly connected to said main body, and a thickening having a second diameter extending transversally to said first axis;

said thickening comprising:

a first face; and a second face opposite to said first face;

said head defining a cavity having an opening at a distal end of the head, said cavity configured to receive a main body of a further structural member carried by a further module superimposable on said module according to said first axis to couple the main body of the further structural member to the structural member of the module;

wherein said first face of said thickening rests directly atop said upper face of said first body;

wherein said second face of said thickening is adapted to cooperate with said further module, said thickening being axially fixed relative to said main body along said first axis so that a downwards load transmitted from said further module to said thickening is transmitted from said thickening to said main body; and wherein said second diameter is at least 1.5 times greater than said first diameter.

27. The module according to claim 26 wherein said head and said thickening are integrally formed as a monolithic component.

* * * * *